United States Patent [19]

Nawn

[11] 4,248,955

[45] Feb. 3, 1981

[54] PHOTOGRAPHIC PROCESSES AND PRODUCTS

[75] Inventor: George H. Nawn, Westwood, Mass.

[73] Assignee: Polaroid Corporation, Cambridge, Mass.

[21] Appl. No.: 106,755

[22] Filed: Dec. 26, 1979

[51] Int. Cl.[3] ..... G03C 1/40; G03C 5/54; G03C 7/00; G03C 5/30

[52] U.S. Cl. ..... 430/219; 430/218; 430/239; 430/240; 430/391; 430/486; 430/487; 430/504; 430/505; 430/607; 430/609

[58] Field of Search ..... 430/218, 219, 239, 240, 430/391, 486, 487, 637, 504, 505, 609, 607

[56] References Cited

U.S. PATENT DOCUMENTS

| | | | |
|---|---|---|---|
| 2,531,832 | 11/1950 | Stanton | 430/487 |
| 3,899,336 | 8/1975 | Land | 430/212 |

OTHER PUBLICATIONS

"Development Modifiers . . . ", Agfa-Gevaert, *Research Disclosure,* No. 11430, 10/1973, pp. 46–51.

*Primary Examiner*—Richard L. Schilling
*Attorney, Agent, or Firm*—Gaetano D. Maccarone

[57] ABSTRACT

A multicolor diffusion transfer photographic system wherein development of an exposed multilayer photosensitive element is effected in the presence of an oligomer which is represented by the formula $$R_1O(CH_2CH_2O)_mR_2$$

wherein $R_1$ and $R_2$ each independently may be $—CH_3$ or $—C_2H_5$ and m is an integer of from 4 to 10.

23 Claims, No Drawings

PHOTOGRAPHIC PROCESSES AND PRODUCTS

BACKGROUND OF THE INVENTION

This application relates generally to photography and, more particularly, to a multicolor diffusion transfer photographic system.

Diffusion transfer photographic systems wherein images are formed in color by the use of dye developers are well known in the art. Generally, multicolor transfer images are formed by processing an exposed multicolor photosensitive silver halide element with a processing composition distributed between two sheet-like elements, one of the elements including an image receiving layer. The processing composition is so applied and confined within and between the two sheet-like elements as not to contact or wet outer surfaces of the two superposed elements, thus providing a film unit whose external surfaces are dry. The processing composition, which may be viscous or non-viscous, preferably is distributed in viscous form from a pressure rupturable container. Such pressure-rupturable processing composition containers are commonly referred to as "pods".

Multicolor diffusion transfer images may be obtained using dye developers by several techniques. A particularly useful technique employs an integral multilayer photosensitive element such as is disclosed in U.S. Pat. No. 2,893,606 and in U.S. Pat. No. 3,345,163 wherein at least two selectively sensitized photosensitive strata, superposed on a common support, are processed, simultaneously and without separation, with a single (common) image-receiving layer. A suitable arrangement of this type for obtaining multicolor images utilizing subtractive color principles comprises a support carrying a red-sensitive silver halide emulsion stratum, a green-sensitive silver halide emulsion stratum and a blue-sensitive silver halide emulsion stratum, said emulsions having associated therewith, respectively, a cyan dye developer, a magenta dye developer and a yellow dye developer. The dye developer may be positioned in the silver halide emulsion stratum, for example in the form of particles, or it may be disposed in a stratum behind the appropriate silver halide emulsion stratum with respect to the exposing light. Each set of silver halide emulsion and associated dye developer strata may be separated from other sets by suitable interlayers, for example, by a layer or stratum of gelatin, polyvinyl alcohol, or other polymeric materials known in the art. In certain instances, it may be desirable to incorporate a yellow filter in front of the green-sensitive emulsion to avoid improper exposure of said emulsion, by blue light, and such a yellow filter may be incorporated in the appropriately positioned interlayer. However, such a separate yellow filter may be omitted where a yellow dye developer of the appropriate spectral characteristics is present in a quantity and state capable of functioning as the requisite yellow filter. Procedures and suitable components for preparing such integral multicolor photosensitive elements are described in numerous patents and are well known in the art.

Following photoexposure, the photosensitive element is processed by application of a processing composition, for example, by immersion, coating, spraying, flowing, etc., in the dark. The exposed photosensitive element may be superposed prior to, during, or after application of the processing composition on a sheet-like element which may include an image-receiving layer. In one commercial embodiment, the processing composition is applied to the photosensitive element in a substantially uniform layer as the photosensitive element is brought into superposed relationship with the image-receiving layer. The liquid processing composition permeates the layers of the photosensitive element to initiate and effect development of the latent images contained therein. The dye developers are immobilized or precipitated imagewise in developed areas as a consequence of and in proportion to the silver halide development. This immobilization is, at least in part, due to a change in the solubility characteristics of the dye developers upon oxidation and especially as regards its solubility in alkaline solution. In undeveloped and partially developed areas of the silver halide emulsion layers, the respective unoxidized (unreacted) dye developers are diffusible. Development thus provides an imagewise distribution of unoxidized dye developer, diffusible in the alkaline processing composition, as a function of the point-to-point degree of exposure of a silver halide emulsion layer. At least part of each of these imagewise distributions of unoxidized dye developer is transferred by imbibition to a superposed image-receiving layer, said transfer substantially excluding oxidized dye developer. The image-receiving layer receives a depthwise diffusion, from each developed silver halide emulsion, of unoxidized dye developer without appreciably disturbing the imagewise distribution thereof to provide a reversed or positive color image of each developed silver image. The image-receiving layer may contain a mordant and/or other agent to immobilize the dye developer transferred thereto. If the color of a transferred dye developer is affected by changes in the pH of the image-receiving layer, this pH may be adjusted in accordance with well known techniques to provide a pH affording the desired color. In the preferred embodiments of U.S. Pat. No. 2,983,606 and in certain commercial applications thereof, the desired positive multicolor image is viewed by separating the image-receiving layer from the photosensitive element at the end of a suitable imbibition period.

In another commercial application of the dye developer process the image-receiving layer is not separated from its superposed relationship with the photosensitive layers subsequent to formation of the transfer image. Instead the color image is viewed through a transparent support. The U.S. Pat. No. 2,893,606 discloses such an embodiment wherein the processing composition includes a white pigment, such as titanium dioxide, in an amount effective to mask or "hide" from view the developed silver halide emulsions now positioned behind the image-receiving layer when the image-receiving layer is viewed through the transparent support.

U.S. Pat. No. 3,415,644 discloses and claims photographic products and processes wherein a photosensitive element and an image-receiving element are maintained in fixed, superposed relationship prior to exposure and this relationship is maintained as a laminate after processing and transfer image formation. The multicolor transfer image is viewed through a transparent (support) sheet against a reflecting, i.e., white, background. Photoexposure is made through said transparent support and the layers carried thereon, including the image-receiving layer, and application of the processing composition provides, a layer of light-reflecting material to provide a white background. The light-reflecting material (referred to in said patent as an "opacifying agent") is preferably titanium dioxide but a number of other materials have been disclosed as useful. In addition to providing a masking layer so the transfer image may be viewed without interference by the images in the developed silver halide emulsions, the light-reflecting material also performs an opacifying function by reflecting ambient light passing through the image-receiving layer and its transparent support when the photoexposed film unit is removed from the camera before transfer image formation is completed, thereby acting to protect the photoexposed silver halide emulsions from post-exposure fogging by such light.

U.S. Pat. No. 3,647,437 is concerned with improvements in the above-mentioned processes, and discloses the provision of a light-absorbing material, sometimes referred to as an optical filter agent, to permit such processes to be performed outside of the camera in which photoexposure is effected and to be so performed under much more intense ambient light conditions. The light-absorbing material or optical filter agent, preferably a dye, is so positioned in the film unit and/or constituted as not to interfere with photoexposure (by absorbing light during photoexposure) but so positioned between the photoexposed silver halide emulsions and the transparent support during processing after photoexposure as to absorb light which otherwise might fog the photoexposed emulsions. Furthermore, the light-absorbing material is so constituted and/or positioned after processing as not to interfere with viewing the desired image in its proper colors shortly after said image has been formed. In the preferred embodiments, the optical filter agent is a dye and is initially contained in the processing composition together with a light-reflecting material, e.g., titanium dioxide. The concentration of this light-absorbing dye is selected to provide the light transmission opacity required to perform the particular process under the selected light conditions, and a plurality of such dyes selected to together provide absorption over the visible spectrum is utilized in multicolor embodiments.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer. Suitable acid-reacting reagents, preferably polymeric acids, are disclosed in the U.S. Pat. Nos. 3,415,644 and 3,647,437.

Suitable materials for use as image-receiving layers are disclosed in the aforementioned patents. The image-receiving layers may comprise polyvinyl alcohol or gelatin containing a dye mordant such as poly-4-vinylpyridine as is disclosed in U.S. Pat. 3,148,061.

As disclosed in the previously cited patents, the liquid processing composition referred to for effecting multicolor diffusion transfer processes comprises at least an aqueous solution of an alkaline material, for example, sodium hydroxide, potassium hydroxide, and the like, and preferably possesses a pH in excess of 12, and most preferably includes a viscosity-increasing compound constituting a film-forming material of the type which, when the composition is spread and dried, forms a relatively firm and relatively stable film. Preferred film-forming materials comprise high molecular weight polymers such as polymeric, water-soluble ethers, for example, a hydroxyethyl cellulose or sodium carboxymethyl cellulose, which are substantially inert in alkaline solution. Other film-forming materials or thickening agents whose ability to increase viscosity is unimpaired if left in alkaline solution for extended periods of time also may be used. The film-forming material is preferably contained in the processing composition in such suitable quantities as to impart to the composition a viscosity appropriate for the particular method of application to be used, such viscosity being in excess of 100 cps, at a temperature of approximately 24° C. and preferably in the order of 100,000 cps. to 200,000 cps. at that temperature.

Dye developers are well known in the art and are compounds which contain both a silver halide developing function and the chromophoric system of a dye. By "a silver halide developing function" is meant a grouping adapted to develop exposed silver halide. The dye developer as incorporated in the photosensitive element may have a "latent" silver halide developing function, i.e., the dye developer may contain a moiety which is a precursor of the silver halide developing function or moiety, the active functional group being formed in situ following application of the processing composition, e.g., by alkaline hydrolysis of an esterified hydroquinonyl group. A preferred silver halide developing function is a hydroquinonyl group. Other particularly useful developing functions include orthodihydroxyphenyl and ortho- and para-amino substituted hydroxyphenyl groups. In general, the developing function includes a benzenoid silver halide developing function, that is, an aromatic silver halide developing group which forms quinonoid or quinone substances when oxidized. The dye developers usually are selected for their ability to provide colors useful in carrying out subtractive color photography, e.g., cyan, magenta and yellow. Other colors, of course, may be provided to meet the needs of a particular system.

In such multicolor applications of diffusion transfer color processes, variations in manufacturing conditions may result in undesirable variations in the sensitometric response, e.g., speed or contrast, of one silver halide emulsion relative to that of either or both of the other silver halide emulsions. Such undesirable variations may be reflected in changes of the H and D curve of, for example, the red record relative to the H and D curves of the green and blue records and may be manifested in the ultimate multicolor image as a shift in color balance, for example, toward the red.

U.S. Pat. No. 3,899,331 discloses a technique for reducing or avoiding such effects by performing the process in the presence of pyrazolo (3,4-d) pyrimidine compounds. The present application relates to the use of ethyleneoxy oligomers in diffusion transfer photographic products and processes to improve the sensitometric response of a multicolor photosensitive element.

SUMMARY OF THE INVENTION

It is therefore the object of this invention to provide a novel diffusion transfer multicolor photographic system wherein a plurality of exposed silver halide emulsions are developed in the presence of an ethyleneoxy oligomer.

It is another object to provide a novel multicolor diffusion transfer photographic system wherein the red, green or blue H and D curve may be preferentially shifted.

It is a further object to provide a novel multicolor diffusion transfer photographic system wherein the color saturation of an individual color in the final photographic reproduction may be increased.

Another object is to provide novel multicolor photographic products and processes.

BRIEF SUMMARY OF THE INVENTION

These and other objects and advantages are accomplished in accordance with the invention by providing a multicolor diffusion transfer photographic system for forming multicolor dye developer tarnsfer images wherein an exposed multilayer photosensitive element is processed in the presence of an ethyleneoxy oligomer represented by the formula $$R_1O—(CH_2CH_2O)_m—R_2$$

wherein $R_1$ and $R_2$ each independently may be $—CH_3$ or $—C_2H_5$ and m is an integer of from 4 to 10.

It has been found that by processing an exposed multilayer photosensitive element in the presence of oligomers within the formula set forth above, it is possible to effect a change in the sensitometric response of the photosensitive element by shifting the speed of an individual silver halide emulsion of the photosensitive element and/or by increasing the color saturation of an individual color in the multicolor diffusion transfer image.

DESCRIPTION OF THE PREFERRED EMBODIMENTS

The preferred oligomers which are utilized in accordance with the invention are represented by the following structural formulas

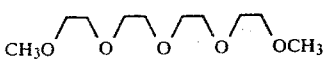
Tetraethyleneglycol Dimethyl Ether (I)

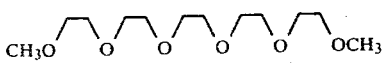
Pentaethyleneglycol Dimethyl Ether (II)

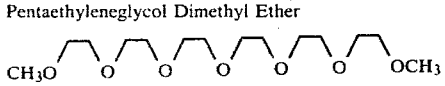
Hexaethyleneglycol Dimethyl Ether (III)

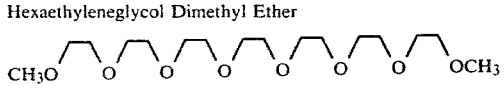
Heptaethyleneglycol Dimethyl Ether (IV)

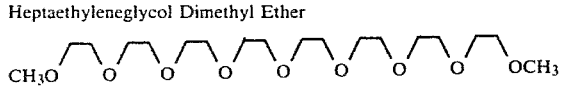
Octaethyleneglycol Dimethyl Ether (V)

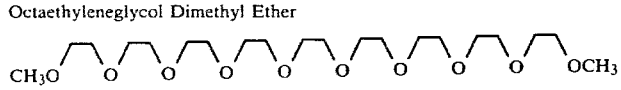
Nonaethyleneglycol Dimethyl Ether (VI)

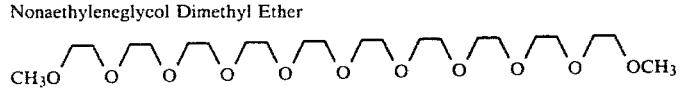
Decaethyleneglycol Dimethyl Ether (VII)

The ethyleneoxy oligomers which are utilized according to the invention may be prepared by reactions which are well known in the art and, in addition, many of these compounds are available commercially. Accordingly, techniques for preparing these compounds need not be discussed here.

The oligomers may be incorporated at various locations within the multicolor diffusion transfer photographic film units of the invention. It is preferred to incorporate the oligomers in the processing composition so that they will be in solution when development is initiated. Although the oligomers may be present in any useful amount, generally they are incorporated in the processing composition in an amount of from about 0.25 to about 4% by weight and preferably from about 1 to about 2% by weight. Where a delay in the availability of some of all of the oligomer is desired, an appropriate amount may be located initially in a layer of the film unit, the time required to dissolve and diffuse from that location thus providing the desired delay.

Experiments conducted with a constant molar concentration of various oligomers have shown that the sensitometric effects brought about by the presence of the oligomers increase as the weight amount of the oligomer present increases. In other words, the sensitometric effects obtained according to the invention are based upon the amont of any particular oligomer present in any instance and not on the molar concentration of the oligomer.

It has been found that the ethyleneoxy oligomers which are employed according to the invention are effective to shift the speed of the individual silver halide emulsions of the multilayer dye developer photosensitive element and, further, that the speed shift may be effected as a function of the concentration of the oligomers. For example, the H and D curve of the green record of the multicolor diffusion transfer image may be shifted toward the H and D curves of the blue and red records of the image so as to provide improved color balance. Thus in such as instance the effect would be manifested in the ultimate multicolor image as a shift in color balance toward the magenta record. It has been found also that a desirable increase in the saturation of a particular color may be obtained according to the invention. For example, in areas of the film which have not received any green light exposure and where, therefore, the fullest possible transfer of green light absorbing image dye developer (the magenta dye developer) is desired, the presence of the oligomers may effect an increase in the amount of this dye developer which is transferred. Such an increase in the amount of dye developer transferred to the image-receiving layer can be measured as the "reflected green density on the toe of the magenta column" of a photographic test target commonly used for such testing or such an increase may be referred to as an increase in the saturation of a particular color, in this illustrative example, "magenta saturation".

In general, a shift in the speed of one of the silver halide emulsions of a multicolor photosensitive element and/or the increase in the saturation of a particular color in the ultimate multicolor image may be obtained through the use of additional alkali content in the processing composition. Thus, the effects obtained through the use of the oligomers according to the invention are, in some respects, akin to those obtained by increasing the alkali content of the processing composition. However, increasing the alkali content of the processing composition is not without at least one important disadvantage. It has been found that the use of additional alkali in the processing composition to provide a speed shift for the silver halide emulsion or to increase the saturation of a particular color in the ultimate image can cause a substantial increase in the $D_{min}$ of the image when the film is processed at a relatively high temperature, for example, about 35° C. or more. Such an effect is, of course, undesirable.

Experimentation has shown that the use of the oligomers according to the invention can provide the desired speed shift and/or increased color saturation without any substantial increase in $D_{min}$ when processing is carried out at such elevated temperatures.

The surprising effects obtained through the use of the oligomers according to the invention are not well understood. However, in order to better aid those skilled in the art to understand and practice the invention, the proposed theoretical mechanism by which the advantageous results are thought to be effected will be discussed here. It should be noted, however, that the invention has been proved to be operable and highly effective through actual experimentation and the proposed theoretical mechanism is not to be construed as being limiting of the invention. The pattern of performance observed through experimentation suggests that the advantageous effects obtained according to the invention are related to the tendency of the oligomers to form strong complexes with metal cations. It is believed that the advantageous effects obtained according to the invention are due, at least in part, to the formation of a complex between the alkali metal cation and the oligomer as a result of which the associated hydroxide ion is rendered more reactive. Such an explanation is consistent with the observation that the sensitometric advantages obtained by the use of the oligomers are similar in some ways to the effects noted when the hydroxide concentration in the processing composition is increased as was referred to above.

The sensitometric response of any multicolor diffusion transfer film unit may be altered according to the invention. Particularly preferred film units according to the present invention are those diffusion transfer integral negative-positive film units of the type described in detail in U.S. Pat. Nos. 3,415,644, 3,594,165 and 3,647,437. Other preferred film units are those which are designed to be separated after processing such as those described in U.S. Pat. Nos. 2,893,606 and 3,345,163. Extensive discussion of the film units of the invention is not required in view of the state of the art. For convenience the entire disclosure of each of the five patents listed immediately above is hereby incorporated by reference herein.

The invention will now be described further in detail with respect to specific preferred embodiments by way of examples, it being understood that these are intended to be illustrative only and the invention is not intended to be limited to the materials, conditions, process parameters, etc., recited therein. All parts and percentages are by weight unless otherwise indicated.

EXAMPLE I

As a control the following experiment was carried out. A film unit was prepared as follows: the negative element was prepared by coating a gelatin-subcoated 4-mil opaque polyethylene terephthalate photographic film base with the following layers, in succession:

1. a layer of a cyan dye developer represented by the formula

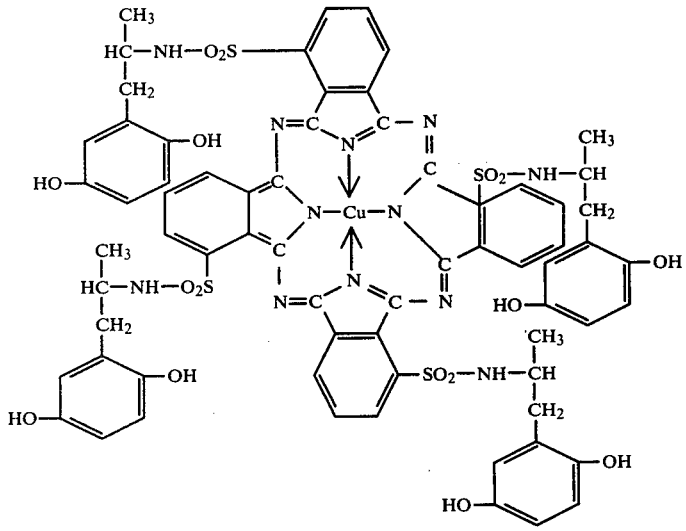

dispersed in gelatin and coated at a coverage of about 742 mg/m$^2$ of dye and 1485 mg/m$^2$ of gelatin and including 68 mg/m$^2$ of 4'-methyl phenyl hydroquinone and about 270 mg/m$^2$ of 2-phenylbenzimidazole;

2. a red sensitive gelatino silver iodobromo emulsion coated at a coverage of about 1291 mg/m$^2$ of silver and about 775 mg/m$^2$ of gelatin;

3. an interlayer of a 60-30-4-6 tetrapolymer of butyl acrylate, diacetone acrylamide, styrene and methacrylic acid at a coverage of about 2505 mg/m$^2$ of the tetrapolymer and about 77 mg/m$^2$ pf polyacrylamide;

4. a layer of a magenta dye developer represented by the formula

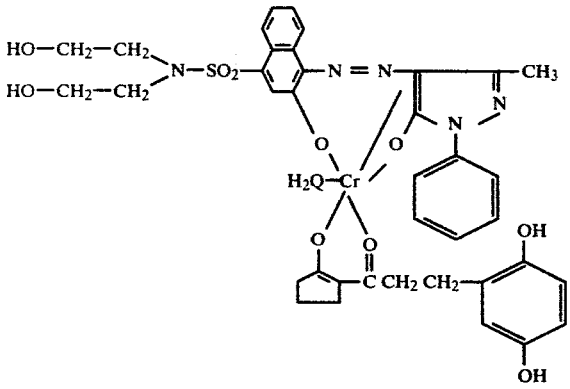

dispersed in gelatin and coated at a coverage of about 646 mg/m$^2$ of the dye developer, about 452 mg/m$^2$ of gelatin and including about 226 mg/m$^2$ of 2-phenylbenzimidazole;

5. a green sensitive gelatino silver iodobromo emulsion coated at a coverage of about 796 mg/m$^2$ of silver and about 387 mg/m$^2$ of gelatin;

6. an interlayer including about 1365 mg/m$^2$ of the tetrapolymer described in layer 3, about 87 mg/m$^2$ of polyacrylamide and about 71 mg/m$^2$ of succinaldehyde;

7. a layer of a yellow dye developer represented by the formula

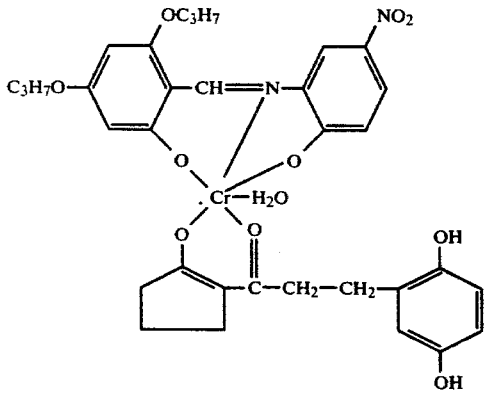

dispersed in gelatin and coated at a coverage of about 986 mg/m$^2$ of the dye developer, about 452 mg/m$^2$ of gelatin and about 204 mg/m$^2$ of 2-phenylbenzimidazole.

8. a blue sensitive gelatino silver iodobromo emulsion coated at a coverage of about 1280 mg/m$^2$ of silver, about 667 mg/m$^2$ of gelatin and about 204 mg/m$^2$ of 4-methylphenyl hydroquinone;

9. a layer of gelatin coated at a coverage of about 484 mg/m$^2$ and including about 43 mg/m$^2$ of carbon black.

The positive element of the film unit was made up of a transparent 4-mil polyethylene tetephthalate film base coated with the following layers in succession:

1. as a polymeric acid layer approximately 9 parts of a ½ butyl ester of polyethylene/maleic anhydride copolymer and 1 part of polyvinyl butyral coated at a coverage of about 26,372 mgs/m$^2$;

2. a timing layer containing about 4575 mgs/m$^2$ of a 60-30-4-6 tetrapolymer of butylacrylate, diacetone acrylamide, styrene and methacrylic acid including 9% polyvinylalcohol; and 3. a polymeric image receiving layer of: (a) 3 parts of a mixture of 2 parts polyvinyl alcohol and 1 part poly-4-vinyl pyridine and (b) 1 part of a graft copolymer comprised of 4-vinyl pyridine (4VP) and vinyl benzyl trimethyl ammonium chloride (TMQ) grafted onto hydroxyethyl cellulose (HEC) at a ratio of HEC/4VP/TMQ 2.2/2.2/1 coated at a coverage of about 3229 mgs/m$^2$.

The film unit was processed with an aqueous alkaline processing composition as follows:

| | |
|---|---|
| Potassium hydroxide (45% solution in water) | 11.67 g |
| N-Phenethyl-α-picolinium bromide (50% solution in water) | 2.54 g |
| Titanium dioxide | 37.40 g |
| Carboxymethyl hydroxyethyl cellulose | 1.99 g |
| N-2-Hydroxyethyl-N,N',N'-tris carboxymethyl ethylene diamine | 0.75 g |
| Polyethylene glycol (MW 4000) | 0.45 g |
| Benzotriazole | 0.55 g |
| 4-Aminopyrazolo (3;4-d) pyrimidine | 0.25 g |
| 6-Methyluracil | 0.70 g |
| Bis-2-benzimidazolylmethyl sulfide | 0.04 g |
| Colloidal silica (30% aqueous dispersion) | 1.85 g |
| 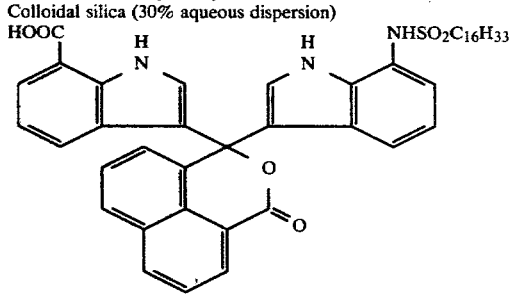 | 0.30 g |
| 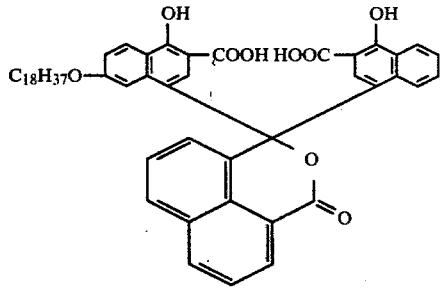 | 1.35 g |
| Water to make a total of | 100 g |

The film unit was then exposed (2 meter candle seconds) on a sensitometer to a photographic test exposure scale, or step wedge, through the transparent support of the image-receiving element and processed with the processing composition by passing the film unit through a pair of pressure rollers at a gap spacing of about 0.0030 inch (about 76 microns). The film unit was retained intact and viewed through the transparent base. There was obtained a well-developed image.

The neutral density column of the multicolor transfer image was increased on a densitometer to obtain the $D_{max}$ and $D_{min}$ values for red, blue and green, respectively. In addition, the speed of the red, blue and green curves, respectively, (defined as the negative log of the relative exposure required to give red, blue and green absorption in the neutral column a reflection density of 0.75) and the green density in the toe of the magenta column were measured. The values are shown in Table I below.

EXAMPLES II–VIII

The procedure described in Example I was repeated in each instance with the exception that the processing composition further included 2.0 g of oligomers I—VII respectively. The values obtained are illustrated in Table I.

TABLE I

| Ex. | Oil-gomer | Rel. Speed R | Rel. Speed G | Rel. Speed B | $D_{max}$ R | $D_{max}$ G | $D_{max}$ B | Green density in magenta toe |
|---|---|---|---|---|---|---|---|---|
| I | — | 1.67 | 1.69 | 1.63 | 2.16 | 1.76 | 1.98 | 0.71 |
| II | I | 1.52 | 1.56 | 1.57 | 2.22 | 2.09 | 2.08 | 0.87 |
| III | II | 1.57 | 1.61 | 1.61 | 2.14 | 2.00 | 1.98 | 0.85 |
| IV | III | 1.53 | 1.55 | 1.56 | 2.24 | 2.11 | 2.06 | 0.88 |
| V | IV | 1.51 | 1.54 | 1.56 | 2.18 | 2.06 | 2.02 | 0.92 |
| VI | V | 1.47 | 1.52 | 1.55 | 2.29 | 2.14 | 2.14 | 0.92 |
| VII | VI | 1.47 | 1.51 | 1.54 | 2.29 | 2.14 | 2.12 | 0.95 |
| VIII | VII | 1.50 | 1.52 | 1.55 | 2.21 | 2.10 | 2.07 | 0.89 |

These results clearly indicate that the presence of the oligomers served to increase appreciably the green $D_{max}$ and, with the exception of oligomer III, to increase the red $D_{max}$ and blue $D_{max}$. Also, the presence of the oligomers shifted the relative red, green and blue speeds to lower values and increased the magenta saturation.

EXAMPLE IX

This example illustrates the sensitometric effects of the alkali level in the processing composition at both room temperature and 35° C. and compares these sensitometric effects with those obtained according to one embodiment of the invention under the same conditions.

The control experiment described in Example I was repeated with the following modifications of the processing composition:

A. No modification

B. 0.5% more KOH

C. 1.6% of oligomer I present

In each instance, processing was carried out at room temperature (approx 24° C.). From the respective multicolor transfer images, there were recorded the speed of the green curve from the neutral density column and the green density from the toe of the magenta column. In addition, processing was carried out in each instance at 35° C. and the red $D_{min}$ of the respective multicolor images recorded. The results are shown in Table II.

TABLE II

| Example | Room Temperature Green Speed | Room Temperature Magenta Saturation | 35° C. Red $D_{min}$ |
|---|---|---|---|
| IX A | 1.61 | 0.78 | 0.21 |
| IX B | 1.48 | 1.07 | 0.24 |
| IX C | 1.48 | 0.98 | 0.22 |

It is clearly apparent from these results that the addition of more potassium hydroxide to the processing composition is effective to both shift the green speed and increase magenta saturation. However, the use of additional alkali to effect these desirable changes also has the undesirable effect of increasing the red $D_{min}$ when processing is carried out at 35° C. On the other hand, the use of the oligomers according to the invention brings about the desirable green speed and magenta saturation changes without any significant increase in the red $D_{min}$ at 35° C.

EXAMPLE X

This example illustrates the sensitometric effects provided by the presence of polyethylene glycol in the processing composition at both room temperature and 7.2° C. and compares these sensitometric effects with those obtained according to one embodiment of the invention under the same conditions.

As a control, the experiment of Example I was repeated with the exception that the processing composition did not include any polyethylene glycol. The control experiment of this example was then repeated with the following modifications of the processing composition:

A. 2% of oligomer V

B. 0.45% of polyethylene glycol (MW 4000)

C. 2% of oligomer V and 0.45% of polyethylene glycol (MW 4000)

The $D_{max}$ values for the red, blue and green were obtained as previously described at room temperature (approximately 24° C.). In addition, the relative red, blue and green speeds were measured at both 24° C. and 7.2° C. The results are shown in Table III.

TABLE III

| | 24° C. $D_{max}$ R | 24° C. $D_{max}$ G | 24° C. $D_{max}$ B | 24° C. Speed R | 24° C. Speed G | 24° C. Speed B | 7.2° C. Speed R | 7.2° C. Speed G | 7.2° C. Speed B |
|---|---|---|---|---|---|---|---|---|---|
| X Control | 1.97 | 1.77 | 1.94 | 1.60 | 1.62 | 1.53 | 1.19 | 1.26 | 1.21 |
| X A | 2.19 | 2.05 | 2.04 | 1.42 | 1.52 | 1.52 | 1.28 | 1.31 | 1.34 |
| X B | 1.94 | 1.86 | 2.02 | 1.53 | 1.54 | 1.51 | 1.26 | 1.36 | 1.38 |
| X C | 2.18 | 2.12 | 2.05 | 1.36 | 1.41 | 1.48 | 1.36 | 1.33 | 1.38 |

It is apparent that the presence of polyethylene glycol provided certain desirable sensitometric effects, for example, the increase in $D_{max}$ for green and blue at 24° C. and the improvement of film speed at 7.2° C. It is also evident that the presence of the oligomer (V) provided similar sensitometric effects as were provided by the polyethylene glycol and also was effective to supplement such effects. As an added advantage, the oligomers, which are significantly lower in molecular weight than the particular polyethylene glycol employed in the comparison, can be utilized at higher weight percentages since phase separations which are sometimes experienced with such relatively high molecular weight polyethylene glycols, were not observed with the oligomers.

Although the invention has been described with respect to various preferred embodiments, it is not intended to be limited hereto, but rather those skilled in the art will recognize that variations and modifications may be made therein which are within the spirit of the invention and the scope of the appended claims.

What is claimed is:

1. A multicolor diffusion transfer photographic process comprising exposing a photosensitive element comprising a blue-sensitive silver halide emulsion having a yellow dye developer associated therewith, a green-sensitive silver halide emulsion having a magenta dye developer associated therewith and a red-sensitive silver halide emuslion having a cyan dye developer associated therewith, applying an aqueous alkaline processing

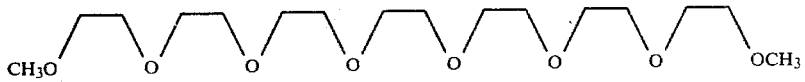

composition to said exposed photosensitive element to effect development and to form an imagewise distribution of unoxidized dye developer in undeveloped areas

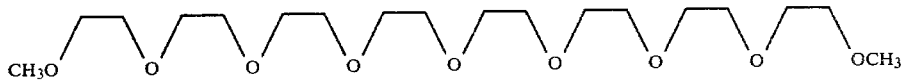

of each of said silver halide emulsions as a function of said development, said process including the step of transferring at least a portion of said image-wise distri-

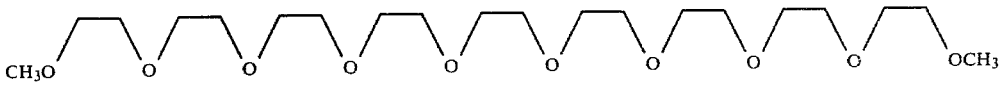

butions of unoxidized dye developers to an image-receiving layer in superposed relationship therewith to thereby provide a multicolor diffusion transfer image,

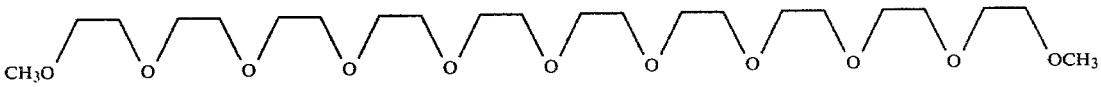

said development being effected in the presence of an oligomer represented by the formula $$R_1O(CH_2CH_2O)_mR_2$$

wherein $R_1$ and $R_2$ each independently is $—CH_3$ or $—C_2H_5$ and m is an integer of from 4 to 10.

2. The process as defined in claim 1 wherein said oligomer is represented by the formula

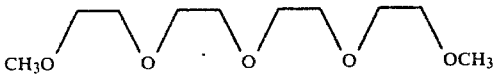

Tetraethyleneglycol DimethyL Ether.

3. The process as defined in claim 1 wherein said oligomer is represented by the formula

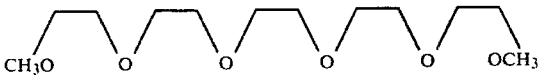

Pentaethyleneglycol DimethyL Ether.

4. The process as defined in claim 1 wherein said oligomer is represented by the formula

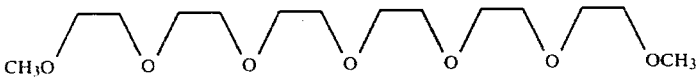

Hexaethyleneglycol Dimethyl Ether.

5. The process as defined in claim 1 wherein said oligomer is represented by the formula Heptaethyleneglycol Dimethyl Ether.

6. The process as defined in claim 1 wherein said oligomer is represented by the formula Octaethyleneglycol Dimethyl Ether.

7. The process as defined in claim 1 wherein said oligomer is represented by the formula Nonaethyleneglycol Dimethyl Ether.

8. The process as defined in claim 1 wherein said oligomer is represented by the formula Decaethyleneglycol Dimethyl Ether.

9. The process as defined in claim 1 wherein said oligomer is present in said processing composition in an amount of from about 0.25 to about 4% by weight.

10. The process as defined in claim 9 wherein said oligomer is present in an amount of from about 1 to about 2% by weight.

11. The process as defined in claim 1 wherein a layer containing titanium dioxide is positioned between said image-receiving layer and said silver halide emulsions whereby said transfer image may be viewed without separating said image-receiving layer from said silver halide emulsions.

12. The process as defined in claim 11 wherein said titanium dioxide is initially present in said processing composition.

13. A photographic product for use in forming a multicolor diffusion transfer image comprising a photosensitive element comprising a support carrying a blue-sensitive silver halide emulsion having a yellow dye developer associated therewith, a green-sensitive silver halide emulsion having a magenta dye developer associated therewith and a red-sensitive silver halide emulsion having a cyan dye developer associated therewith, a second sheet-like element positioned in superposed or superposable relationship with said photosensitive element, an image receiving layer positioned in one of said elements, a rupturable container releasably holding an aqueous alkaline processing composition adapted, when distributed between a pair of predetermined layers carried by said photosensitive element and said second element to develop said silver halide emulsions and provide a multicolor diffusion transfer image on said image-receiving layer, said product including an oligomer represented by the formula $$R_1O(CH_2CH_2O)_mR_2$$

wherein $R_1$ and $R_2$ each independently is $—CH_3$ or $—C_2H_5$ and m is an integer of from 4 to 10.

14. The photographic product as defined in claim 13 wherein said oligomer is represented by the formula

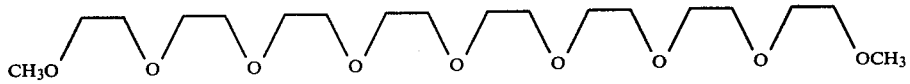

Tetraethyleneglycol Dimethyl Ether.

15. The photographic product as defined in claim 13 wherein said oligomer is represented by the formula

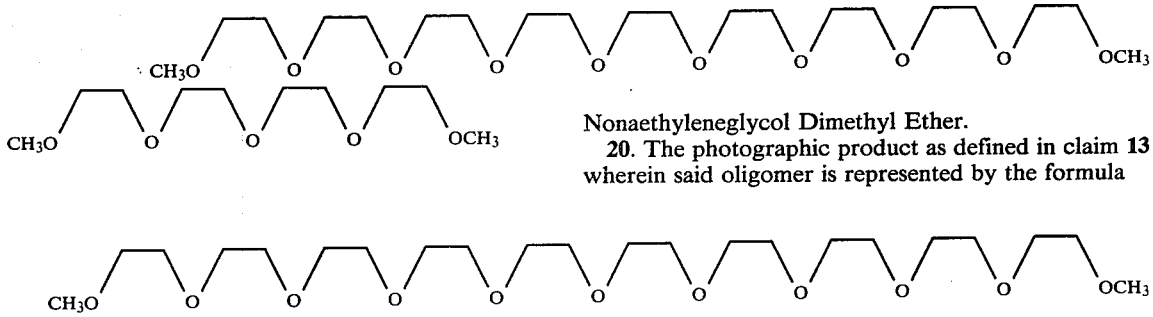

Pentaethyleneglycol Dimethyl Ether.

16. The photographic product as defined in claim 13 wherein said oligomer is represented by the formula

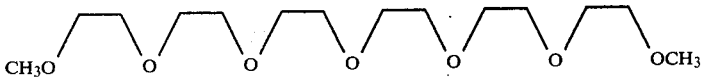

Hexaethyleneglycol Dimethyl Ether.

17. The photographic product as defined in claim 13 wherein said oligomer is represented by the formula

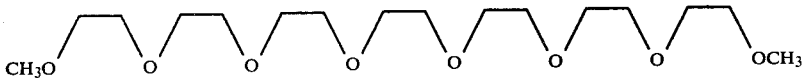

Heptaethyleneglycol Dimethyl Ether.

18. The photographic product as defined in claim 13 wherein said oligomer is represented by the formula Octaethyleneglycol Dimethyl Ether.

19. The photographic product as defined in claim 13 wherein said oligomer is represented by the formula Nonaethyleneglycol Dimethyl Ether.

20. The photographic product as defined in claim 13 wherein said oligomer is represented by the formula Decaethyleneglycol Dimethyl Ether.

21. The photographic product as defined in claim 14 wherein said oligomer is present in said processing composition in an amount of from about 0.25 to about 4% by weight.

22. The photographic product as defined in claim 21 wherein said oligomer is present in an amount of from about 1 to about 2% by weight.

23. The photographic product as defined in claim 14 wherein said second element includes said image-receiving layer carried by a transparent support and said processing composition includes titanium dioxide.

* * * * *